US008128264B2

(12) United States Patent
Genenbacher

(10) Patent No.: US 8,128,264 B2
(45) **Date of Patent: *Mar. 6, 2012**

(54) MAGNETIC LIGHT FIXTURE

(76) Inventor: Shawn Michael Genenbacher, Lubbock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/463,129

(22) Filed: May 8, 2009

(65) Prior Publication Data

US 2010/0290240 A1 Nov. 18, 2010

Related U.S. Application Data

(63) Continuation-in-part of application No. 11/676,146, filed on Feb. 16, 2007, now Pat. No. 7,549,779.

(51) Int. Cl.
*F21V 21/08* (2006.01)

(52) U.S. Cl. ..... 362/398; 362/249.01; 362/808

(58) Field of Classification Search ..... 362/249.01, 362/249.14, 398, 808
See application file for complete search history.

(56) References Cited

U.S. PATENT DOCUMENTS

| | | | | |
|---|---|---|---|---|
| 2,474,942 | A | 7/1949 | Hawkins | |
| 3,038,139 | A | 6/1962 | Bonanno | |
| 5,388,802 | A | 2/1995 | Dougan | |
| 5,788,362 | A * | 8/1998 | Chou | 362/249.01 |
| 5,873,651 | A * | 2/1999 | Hofer et al. | 362/396 |
| 2006/0138293 | A1 | 6/2006 | Raymond | |

* cited by examiner

*Primary Examiner* — John A Ward
(74) *Attorney, Agent, or Firm* — Carstens & Cahoon, LLP; Vincent J. Allen

(57) ABSTRACT

The present invention provides a light fixture assembly. In one embodiment, the assembly includes a light bulb socket with an opening at one end for accommodating C7/C9 light bulbs and at least one opening at the second end. The socket includes a conductor that places a light bulb into electrical contact with electrical wires inserted through the side of the socket. The assembly also includes a base attached to the second end of the socket. The base includes a wire clamp that fits through the opening in the second end of the socket and holds the electrical wires in contact with the conductor. Retaining clips on the base apply a retaining force against the socket to hold the base in place. A strong magnet is embedded in the base, thereby allowing the assembly to be mounted magnetically to metal surfaces.

26 Claims, 3 Drawing Sheets

MAGNETIC LIGHT FIXTURE

CROSS-REFERENCE TO RELATED APPLICATION

This application is a continuation-in-part patent application of a pending application of U.S. Ser. No. 11/676,146 filed on Feb. 16, 2007, now U.S. Pat. No. 7,549,779 entitled "Magnetic Light Fixture," the technical disclosure of which is hereby incorporated herein by reference.

BACKGROUND OF THE INVENTION

The present invention relates generally to decorative lights. More specifically the invention relates to decorative lights that are mounted to metal surfaces by means of imbedded magnets.

Decorative lights typically do not come provided with means for mounting them to display surfaces such as housing sides or poles. The traditional means of attaching such decorative lights is by stapling them to the sides of houses or trees or wrapping them around poles and trees. However, stapling has several potential drawbacks including damage to the mounting surface (which increases with repeated mounting and dismounting of the lights), potential damage to the electrical cord from the staples, as well as potential injury to the user during the stapling process. Stapling also turns the light mounting process into a two-handed operation, requiring one hand to hold the lights and wires in place and the other to work the stapler. Stapling is also unsatisfactory in cases where houses have metal siding.

In the case of metal poles or similar objects, simply wrapping the light wires may not properly secure them in position and prevent them from falling. In such situations, securing methods such as tape might not provide sufficient long term adherence, especially outdoors, and might be visually unappealing.

Several methods have been proposed in the prior art for overcoming the above disadvantages. One solution is provided by Dougan et al. (U.S. Pat. No. 5,388,802). This approach provides a clip that is secured to the electric cord that connects a string of lights. The main body of the clip is a flexible, V-shaped member which is compressed and wedged between the fascia and soffit of a house. When installed, the lights protrude perpendicularly below the fascia and are clearly visible, while the wedge shaped members are substantially hidden from view by the fascia. While the Dougan invention offers substantial improvements over simply stapling the lights in place, it is limited to mounting lights on the eaves on a house. Furthermore, Dougan requires a separate set of clips/wedges to be purchased and then added to the string of lights before mounting them. While the insertion and removal of the wedges from the fascia and soffit may seem simple in theory, it is likely the user will encounter some difficulties in this operation.

Another proposed solution to mounting decorative lights is that of Clement (U.S. Patent Application No. 2006/0138293). Similar to Dougan, Clement provides a member that is clipped to the electrical cord of a string of decorative lights. Unlike Dougan, the member taught in Clement uses a magnet to secure it to metal surfaces. This approach provides more flexibility in mounting options as well as greater ease of mounting than the Dougan invention. However, Clement still requires the user to purchase a separate set of members and then clip them onto the electrical cord of the light sting before mounting the lights, requiring additional time and effort.

Therefore, it would be desirable to have a method for temporarily mounting a string of decorative lights to a metal surface without the need for damaging the surface and without the need to install additional items to the light string.

SUMMARY OF THE INVENTION

The present invention provides a light fixture assembly. In one embodiment of the invention, the assembly includes a light bulb socket with an opening at one end for accommodating C7/C9 light bulbs and at least one opening at the second end. The socket includes a conductor that places a light bulb into electrical contact with electrical wires inserted through the side of the socket. The assembly also includes a base attached to the second end of the socket. The base includes a wire clamp that fits through the opening in the second end of the socket and holds the electrical wires in contact with the conductor. Retaining clips on the base apply a retaining force against the socket to hold the base in place. The retaining clips may be molded from the sides of the wire clamp or independent from the clamp and inserted through separate holes in the end of the socket. In one embodiment, an N40 neodymium disc magnet is embedded in the base, thereby allowing the assembly to be mounted magnetically to metal surfaces. Although neodymium magnets have been selected as the best choice for this invention given the cost, weight, and strength of such magnets, other types of magnets such as samarium cobalt and alnico may be used without departing from the scope and spirit of the invention. In an embodiment, the neodymium magnet is ½ inch diameter and ⅛ inch thick and mounted flush with the surface of the base, with a pull strength of approximately 16 pounds. In an alternate embodiment, the light assembly may also include an external clip on the side of either the base or the socket. In an alternative embodiment, the magnet may be embedded into a separate component to allow for removable attachment to the base of the light fixture assembly such that damaged or lost magnets can be easily replaced without replacing the entire light fixture assembly.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

The present invention provides a magnetic base for decorative lights that are strung together by an electrical cord. The invention works with standard C7/C9 light bulbs and other light bulbs known in the art.

Figure 1:
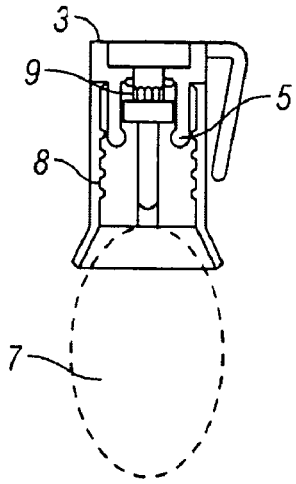
FIG. 1 is a cross section view of a light assembly in accordance with an embodiment of the present invention.

FIG. 1 is a cross section view of a light assembly in accordance with an embodiment of the present invention. The light assembly is comprised of three major components. The first is the light bulb 7, which is depicted in dashed outline. The second major component is the light bulb socket 8. The third component is the assembly base 3.

Figure 2:
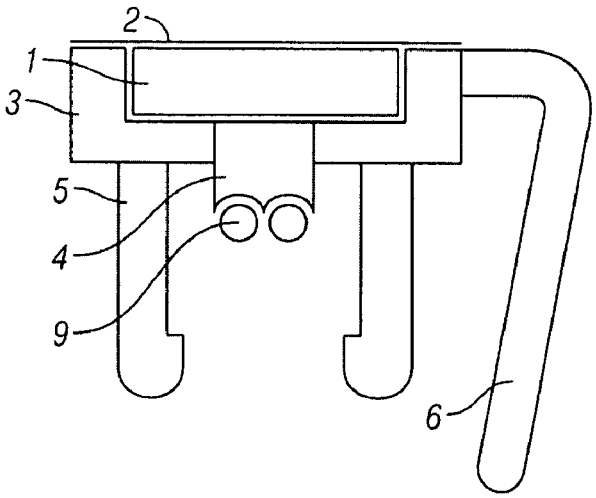
FIG. 2 is a detailed cross section view of the assembly base containing a magnet in accordance with an embodiment of the present invention.

FIG. 2 is a detailed cross section view of the assembly base containing a magnet in accordance with an embodiment of the invention. The assembly base 3 is constructed of plastic or similar material and has an embedded neodymium magnet 1. In an embodiment, the magnet 1 is a disc ½ inch diameter×⅛ inch thick. Other shapes, sizes and thicknesses can be used, but the dimensions of the disc magnet disclosed may be used with a C7/C9 light socket.

A neodymium magnet can be made from a combination of neodymium, iron, and boron ($Nd_2Fe_{14}B$). Neodymium magnets have replaced the marginally weaker samarium-cobalt magnets in most applications, due mainly to lower cost. These magnets are very strong in comparison to their mass and are graded in strength from N24 to the strongest N54. The number after the N represents the magnetic energy product, in megagauss-oersteds (MGOe). In an embodiment, the neodymium magnet is an N40 type with a pull force of 16 pounds. Other types of magnets such as samarium-cobalt and alnico with various strengths and dimensions may be used, but ideally, the magnet pull force should be sufficient to hold the light assembly in place in normal outdoor conditions including wind. A pull force of 5 pounds for a typical C7/C9 assembly may be sufficient in most cases, but a higher pull force as is provided with the neodymium magnet is preferred to provide sufficient margin to avoid detachment by wind forces. For lighter assemblies, less force is required to prevent detachment. As mentioned, however, other magnets of sufficient strength can be used without departing from the scope and spirit of the invention.

Figure 3:
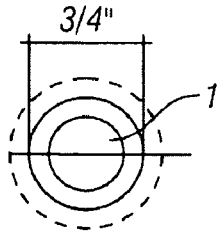
FIG. 3 is a plan view of the assembly base in accordance with an embodiment of the present invention.

As shown, the magnet 1 is embedded flush with the surface of the assembly base 3, allowing only the face of the magnet to be exposed. The exposed face of the magnet 1 is illustrated in the plan view of the base in FIG. 3. A plastic protection coating 2 is placed over the face of the magnet 3.

The base 3 also includes two retaining clips 5 for engaging the light socket 8 and holding the base in place. A molded wire clamp 4 in the base helps to hold the electrical wires 9 in contact with a copper conductor 10 in the socket 8 when the base 3 and socket 8 are assembled, as shown in FIG. 1.

Figure 4:
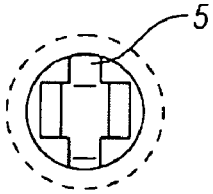
FIG. 4 is a bottom plan view of the assembly base showing the ends of retaining clip in accordance with an embodiment of the present invention.

FIG. 4 is a bottom plan view of the assembly base showing the ends of retaining clips 5 in accordance with an embodiment of the present invention.

The assembly base 3 may optionally include a side clip 6 which may be used to mount the light on a nonmetallic structure or may be used to mount additional decorations to the light.

Figure 5:
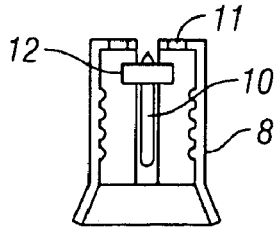
FIG. 5 is a detailed cross section view of the light socket in accordance with an embodiment of the present invention.

FIG. 5 is a detailed cross section view of the light socket in accordance with an embodiment of the present invention. Like the base 3, the socket 8 can be made from plastic or similar material. On the inside of the socket are two copper conductors 10 (only one which is illustrated in FIG. 5). The conductors 10 provide electrical connection between the wires 9 and the base of the light bulb (not pictured).

The socket 8 includes two slots 11, which accommodate the retaining clips 5 on the base 3. Inside the socket 8 is a retaining tab 12. The retaining tab 12 applies a retaining force against the ends of the retaining clips 5 when the assembly base 3 is mounted to the bottom of the socket 8. The retaining tab 12 also helps hold the electric wires 9 in place by acting as the opposing surface to the wire clamp 4 when the base and socket are assembled, as illustrated in FIG. 1. In an embodiment, the base 3 and socket 8 are both ¾ inch diameter (see FIG. 3).

Figure 6:
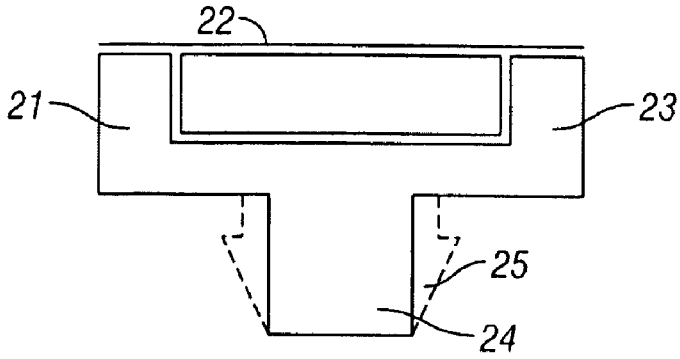
FIG. 6 is a detailed cross section view of the assembly base containing the magnet in accordance with an alternate embodiment of the present invention.

FIG. 6 is a detailed cross section view of the assembly base containing the magnet in accordance with the alternate embodiment. The alternate embodiment of the assembly base 23 is very similar the assembly base 3 depicted in FIG. 2, the primary difference being the shape of the retaining clips 25 and the wire clamp 24. In this embodiment, the retaining clips 25 are molded from the sides of the wire clamp 24, as shown.

Unlike the assembly base 3 depicted in FIG. 2, the example depicted in FIG. 6 does not include a side clip 6. However, it should be noted that a side clip can be added to either version of the assembly base or alternatively to the side of the light bulb socket, as shown in FIG. 9B.

Figure 7:
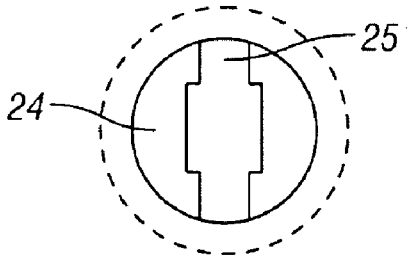
FIG. 7 is a bottom plan view of the alternate assembly base showing the bottom end of the wire clamp and side retaining clips in accordance with the alternate embodiment of the present invention.

FIG. 7 is a bottom plan view of the alternate assembly base showing the bottom end of the wire clamp 24 and side retaining clips 25 in accordance with the alternate embodiment of the present invention.

Figure 8:
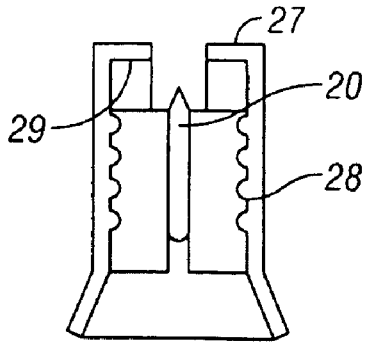
FIG. 8 is a detailed cross section view of the light socket in accordance with the alternate embodiment of the present invention.

FIG. 8 is a detailed cross section view of the light socket in accordance with the alternate embodiment of the present invention. In this embodiment, the socket 28 has a single, central slot 27 to accommodate the wire clamp 24. The retaining clips 25 engage the inside surface of the socket 29 when inserted through the slot 27.

Figure 9A:
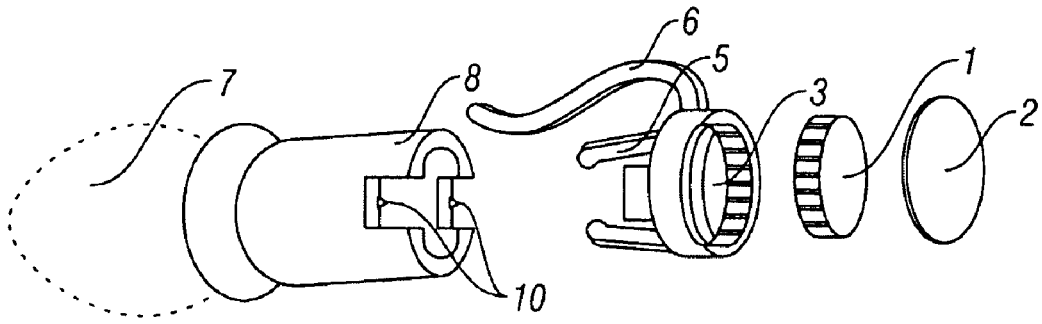
FIG. 9A is an exploded perspective view of the light assembly in accordance with an embodiment of the present invention.
Figure 9B:
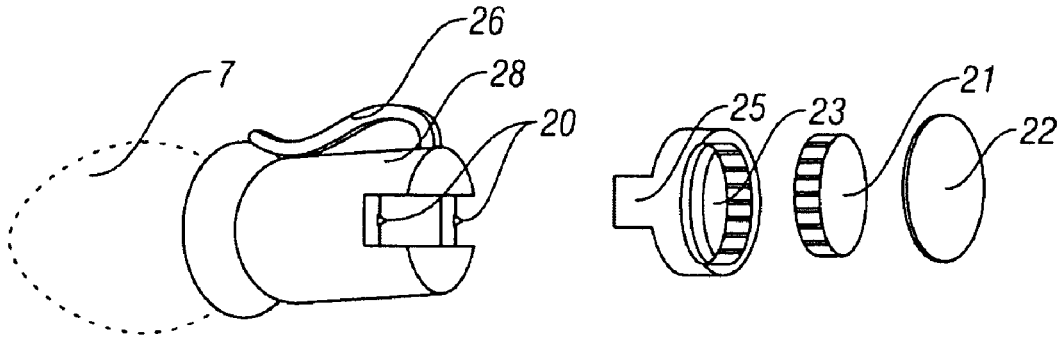
FIG. 9B is an exploded perspective view of the light assembly in accordance with an alternate embodiment of the present invention.

FIG. 9A is an exploded perspective view of the light assembly in accordance with a preferred embodiment of the present invention. This example comprises the component embodiments depicted in FIGS. 2-5.

FIG. 9B is an exploded perspective view of the light assembly in accordance with an alternate embodiment of the present invention. This example comprises the component embodiments depicted in FIGS. 6-8. As mentioned above, FIG. 9B also shows an embodiment in which an optional side clip 26 is added to the socket 28 instead of the assembly base 23.

In an alternative embodiment not shown in the drawings, the base of the light assembly can be separated into two components such that the magnet can be replaced without replacing the entire light assembly. A separate end piece for the base contains a magnet embedded as described above in reference to other embodiments. One end of the separate end can be removably joined to the main base of the light assembly. The manner of joining can be by threading the main base and the separate end piece to allow the end piece with magnet embedded to be screwed into the main base of the light assembly. Other means of attachment such as a quick disconnect type snap may be employed without departing from the scope and spirit of the invention. Should the magnet fail, or should it become dislodged from the separate end piece, the separate end piece can be removed and replaced with a new one.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A light fixture assembly, comprising:

a light bulb socket with an opening at a first end for accommodating a light bulb and a second opening for insertion of electrical wires, wherein the socket includes two conductors that places a light bulb inserted into the first end in electrical contact with said electrical wires;

a base integrally attached to the second end of the light bulb socket; and a magnet embedded in the base such that said magnet does not protrude outside of said base, wherein said magnet has sufficient pull force to hold said light fixture assembly to a ferrous object while said light fixture assembly is connected to a string of other light fixture assemblies.

2. The light fixture assembly of claim 1, wherein said base comprises a removable end piece within which said magnet is embedded.

3. The light fixture of claim 2, wherein said removable end piece comprises a first end with a threaded portion for mating with a threaded portion of said base for removably attaching said removable end piece to said base.

4. The light fixture of claim 3, wherein said magnet is substantially cylindrical and wherein said magnet is substantially flush with a second end of said removable end piece.

5. The light fixture of claim 4, further comprising a protective cover placed over said magnet.

6. The light fixture assembly of claim 1, wherein said base comprises:

a wire clamp that fits through said second opening and holds each of said electrical wires in contact with a respective one of said two conductors; and retaining clips that apply a retaining force against the socket to hold the base in place.

7. The light fixture assembly according to claim 6, wherein the retaining clips on the base are molded into the sides of the wire clamp and fit through the same hole in the second end of the socket as the wire clamp.

8. The light fixture assembly according to claim 6, wherein the retaining clips on the base are separate from the wire clamp and fit through separate holes in the second end of the socket.

9. The light fixture assembly according to claim 1, wherein the socket accommodates C7 light bulbs.

10. The light fixture assembly according to claim 1, wherein the socket accommodates C9 light bulbs.

11. The light fixture assembly according to claim 1, wherein the magnet is chosen from the following group: neodymium, samarium-cobalt and alnico.

12. The light fixture assembly according to claim 1, wherein the magnet has a pull strength of at least 16 pounds.

13. The light fixture assembly according to claim 1, wherein the magnet is a disc one half inch in diameter and one eighth inch thick.

14. The light fixture assembly according to claim 13, wherein the socket and the base are three quarter inch diameter.

15. The light fixture assembly according to claim 1, further comprising an external clip on the side of the base.

16. The light fixture assembly according to claim 1, further comprising an external clip on the side of the socket.

17. A method for installing a string of light fixture assemblies, said method comprising the steps:

selecting a location containing a ferrous metal surface; and attaching at least one of said light fixture assemblies to said ferrous metal surface by touching a base of said at least one of said light fixture assemblies to said ferrous metal surface, wherein said base is integrally attached to an end of the light bulb socket and wherein a magnet is embedded in said base such that said magnet does not protrude outside of said base, wherein said magnet has sufficient pull force to hold said at least one of said light fixture assemblies to said ferrous metal surface while said at least one of said light fixture assemblies is connected to said string of other light fixture assemblies.

18. The method of claim 17, wherein said magnet is chosen from the following group:

neodymium, samarium-cobalt and alnico.

19. The method of claim 17, wherein said at least one of said light fixture assemblies may be removed by hand from said ferrous metal surface by tugging on said light fixture assembly.

20. The method of claim 17, wherein said at least one of said light fixtures comprises a C9 type bulb.

21. The method of claim 17, wherein said base comprises a removable end piece within which said magnet is embedded.

22. The method of claim 21, wherein said removable end piece comprises a first end with a threaded portion for mating with a threaded portion of said base for removably attaching said removable end piece to said base.

23. The method of claim 22, wherein said magnet is substantially cylindrical and wherein said magnet is substantially flush with a second end of said removable end piece.

24. The method of claim 23, wherein a protective cover is placed over said magnet.

25. The method of claim 17, wherein said magnet has a pull strength of at least 16 pounds.

26. The method of claim 17, wherein said magnet is a disc one half inch in diameter and one eighth inch thick.

* * * * *